US011609512B2

(12) United States Patent
Pines et al.

(10) Patent No.: US 11,609,512 B2
(45) Date of Patent: Mar. 21, 2023

(54) FILTERING PRINTING FLUID

(71) Applicant: Hewlett-Packard Development Company, L.P., Spring, TX (US)

(72) Inventors: Assaf Pines, Ness Ziona (IL); Mark Sandler, Ness Ziona (IL); Eran Schwimmer, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/578,126

(22) Filed: Jan. 18, 2022

(65) Prior Publication Data

US 2022/0214634 A1 Jul. 7, 2022

Related U.S. Application Data

(63) Continuation of application No. 17/051,108, filed as application No. PCT/US2018/047428 on Aug. 22, 2018, now Pat. No. 11,256,196.

(51) Int. Cl.
*G03G 15/10* (2006.01)

(52) U.S. Cl.
CPC ..... *G03G 15/104* (2013.01)

(58) Field of Classification Search
CPC .... G03G 15/10; G03G 15/104; G03G 15/105; G03G 2215/0658
See application file for complete search history.

(56) References Cited

U.S. PATENT DOCUMENTS

| | | | | |
|---|---|---|---|---|
| 4,320,407 | A | 3/1982 | Goldis et al. | |
| 4,987,429 | A | 1/1991 | Finley et al. | |
| 6,011,943 | A * | 1/2000 | Kim | G03G 15/104 399/237 |
| 6,312,074 | B1 | 11/2001 | Walker | |
| 7,643,776 | B2 | 1/2010 | Walton et al. | |
| 8,727,513 | B2 | 5/2014 | Bachar et al. | |
| 9,016,198 | B2 | 4/2015 | Lam et al. | |
| 9,400,454 | B1 | 7/2016 | Falk et al. | |
| 2009/0116876 | A1 | 5/2009 | Nishiyama et al. | |
| 2012/0079955 | A1 | 4/2012 | Lam et al. | |
| 2013/0308984 | A1 * | 11/2013 | Sandler | B41J 2/18 399/237 |
| 2014/0105648 | A1 | 4/2014 | Bachar et al. | |
| 2018/0017882 | A1 | 1/2018 | Shkuri et al. | |

FOREIGN PATENT DOCUMENTS

CN 1284431 A 2/2001

* cited by examiner

*Primary Examiner* — Thomas S Giampaolo, II

(57) ABSTRACT

Disclosed is a method to mitigate deterioration of printing fluid in a tank of a printer. The method comprises: draining printing fluid from a tank of a printer, and stopping the draining before the tank is empty, wherein the printing fluid comprises solids suspended in imaging oil, filtering the printing fluid drained from the tank, to separate at least some of the solids from the imaging oil, passing the filtered imaging oil to a reservoir; and then passing imaging oil from the reservoir to the tank. Also disclosed is a printer and a system to perform the method.

20 Claims, 4 Drawing Sheets

FILTERING PRINTING FLUID

CROSS-REFERENCE TO RELATED APPLICATIONS

This application is a Continuation of U.S. application Ser. No. 17/051,108, filed Oct. 27, 2020, which is a U.S. National Stage Application of International Application No. PCT/US2018/047428, filed Aug. 22, 2018, each of which is incorporated herein by reference.

BACKGROUND

Some printers use printing fluid that comprises solids suspended in imaging oil. Under some circumstances, the printing fluid can degrade whilst the printing fluid is stored in a tank of the printer prior to printing. The degradation can result in the printing fluid no longer being suitable for printing at the desired quality.

In such circumstances, an operator of the printer replaces the printing fluid and resumes printing. It is desirable to reduce printer downtime due to degradation in printing fluid stored in a tank of a printer prior to printing.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

Some printers, such as liquid electrophotographic printers, use printing fluid that comprises solids suspended in imaging oil. The imaging oil may not be printed by the printer and can be recycled by the printer.

The disclosure provides methods and apparatus to mitigate degradation of printing fluid stored in a tank of a printer. It has been found that printing fluid degradation can be mitigated by replacing a portion of the printing fluid in such a tank, rather than all of the printing fluid in the tank. This can help to minimize waste produced by the printer.

Figure 1:
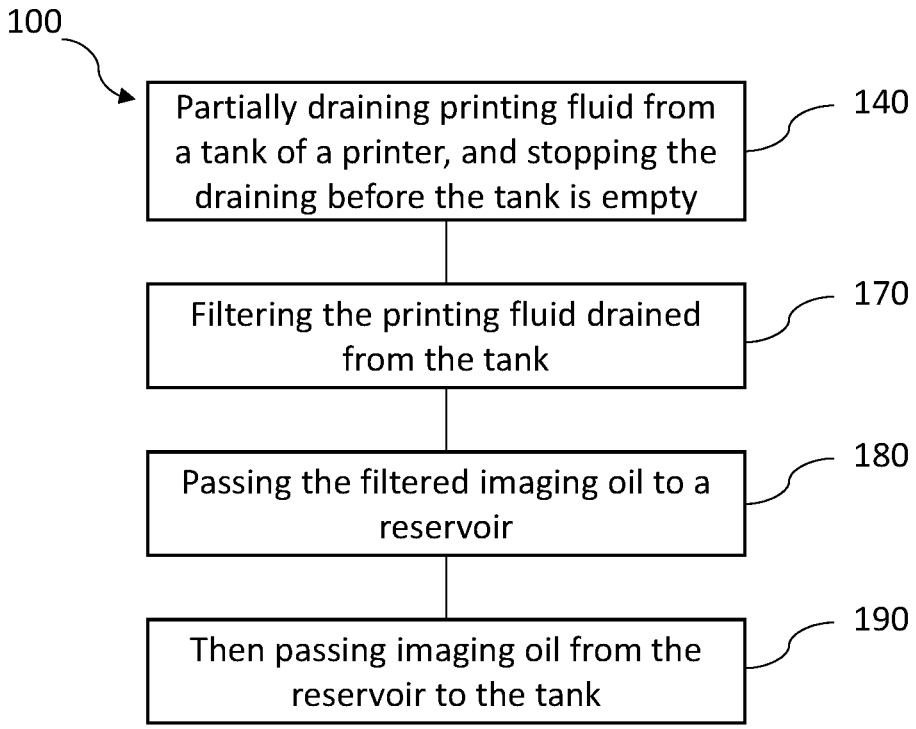
FIG. 1 is a flow diagram of a method according to the disclosure.

FIG. 1 is a flow diagram of a method 100 according to the disclosure. The method may be suitable for refreshing printing fluid in a tank of a printer to mitigate degradation of the printing fluid stored in the tank. The method 100 comprises draining 140 printing fluid from a tank of a printer, and stopping the draining before the tank is empty. The tank is therefore partially drained so that a volume of printing fluid remains in the tank after the draining 140 is complete. The amount of printing fluid drained from the tank during the draining 140 may be proportional to a degree of degradation of the printing fluid.

The printing fluid comprises solids suspended in imaging oil. The printing fluid is stored in the tank for printing by the printer. The method 100 comprises filtering 170 the printing fluid drained from the tank, to separate at least some of the solids from the imaging oil. The draining 140 may comprise pumping printing fluid from the tank to a filtering station at which the filtering 170 takes place. The filtering 170 may comprise separating substantially all of the solids from the imaging oil. The filtering 170 may comprise passing solids removed from the imaging oil to a waste container (not shown). The waste container may be periodically emptied and the contents disposed of, for example manually by an operator of the printer.

The method 100 comprises passing 180 the filtered imaging oil to a reservoir. The reservoir may receive filtered imaging oil from the filtering station and imaging oil from one or more other sources within the printer. Filtered imaging oil stored in the reservoir may be constantly or periodically circulated around the reservoir to help provide a uniform composition of imaging oil throughout the reservoir.

The method 100 comprises then passing 190 imaging oil from the reservoir to the tank. The imaging oil passed from the reservoir to the tank mixes with the printing fluid remaining in the tank after the draining 140. Solids may also be provided in the tank, to mix with the imaging oil passed from the reservoir to the tank, to help restore a predetermined concentration of solids suspended in imaging oil within the printing fluid stored in the tank.

At least a portion of the method 100 may be performed automatically by the printer. For example, stopping the draining before the tank is empty may be performed in response to a determination that the volume of printing fluid in the tank has fallen below a draining threshold. For example, passing 190 imaging oil from the reservoir to the tank may be performed in response to a determination by the printer that the volume of printing fluid in the tank has fallen below a printing fluid volume threshold. All of the method 100 may be performed automatically by the printer. The method 100 may be performed at automatically at predetermined intervals. The method 100 may be performed continuously when printing fluid is stored in the tank.

The method 100 may be performed in response to an operator command. The operator command is input to the printer by an operator of the printer. The operator may input the operator command in response to determining degradation of the printing fluid stored in the tank.

The method 100 may be performed multiple times to mitigate degradation of the printing fluid stored in the tank.

The method 100 can help to reduce the downtime of the printer caused by the need to mitigate degradation of printing fluid in the tank, because the draining 140 is stopped before the tank is empty and because the imaging oil is re-used. The method 100 may be performed whilst the printer is performing a printing process using printing fluid from the tank. The method 100 may allow a printer to mitigate printing fluid degradation without components of printing fluid being supplied to the printer from an external source.

Figure 2:
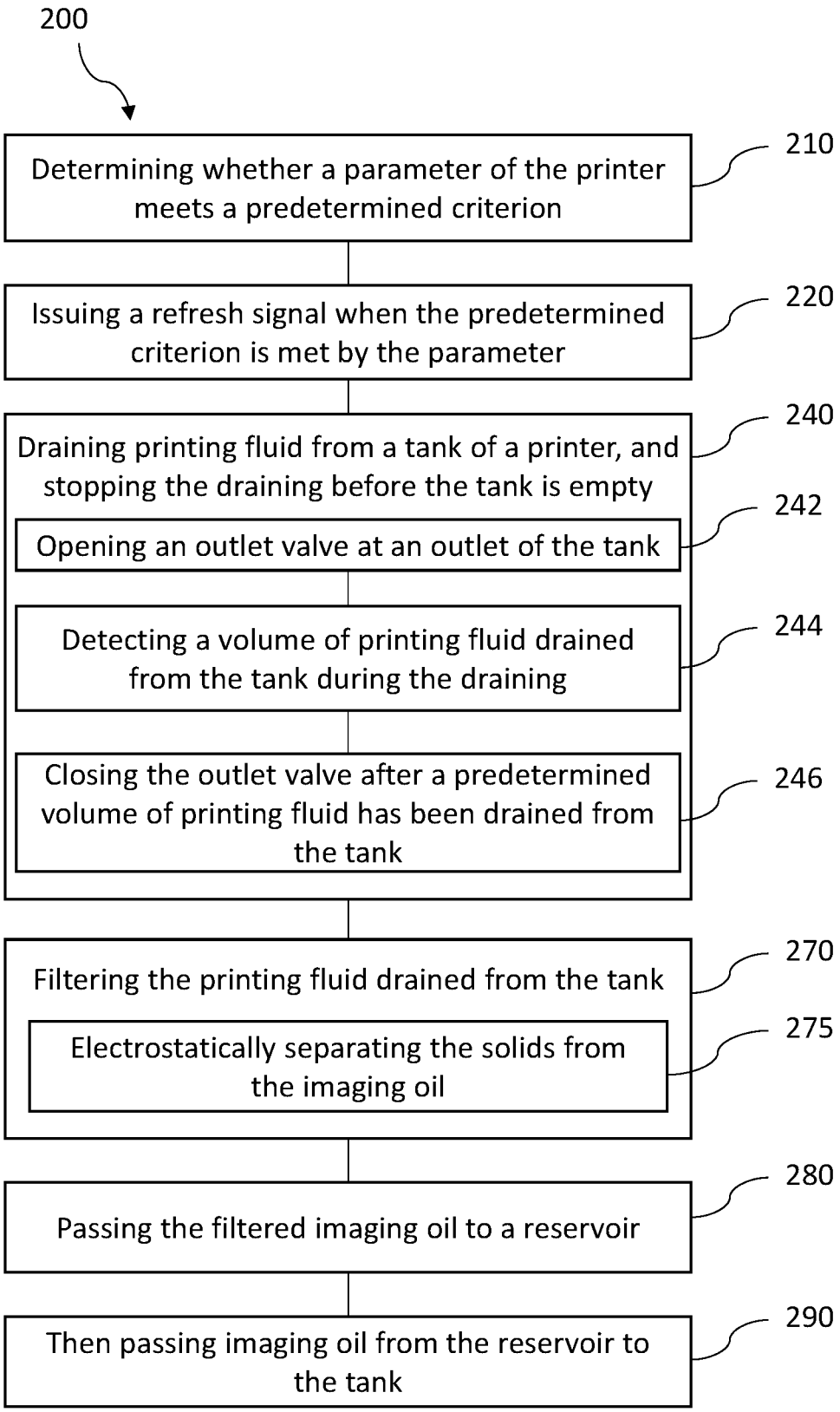
FIG. 2 is a flow diagram of a method according to the disclosure.

FIG. 2 is a flow diagram of a method 200 according to the disclosure. The method 200 comprises the method of 100 described with reference to FIG. 1. Corresponding parts of the method 200 have the same reference number as for the method 100, but increased by 100. The corresponding parts of the method 200 will not be described again with reference to FIG. 2.

The method 200 may comprise determining 210 whether a parameter of the printer meets a predetermined criterion, and issuing 220 a refresh signal when the predetermined criterion is met by the parameter. The parameter may be indicative of degradation of printing fluid stored in the tank. The parameter may, for example, comprise one or more of: a print quality achieved by the printer, a colour calibration accuracy, a concentration of solids in the printing fluid, a printing fluid temperature, a printing fluid viscosity, and a volume of printing fluid in the tank. The refresh signal may be issued when the parameter reaches a certain threshold.

Determining 210 that the parameter of the printer meets the predetermined criterion may be achieved before a visually noticeable degradation in print quality achieved by the printer can be detected. This can help to allow the printer to continue to perform a printing process whilst performing the method 200.

The draining 240 is performed on the basis of the refresh signal. The draining 240 may be performed automatically by the printer in response to the refresh signal. The draining 240 may be performed on the basis of the refresh signal and an operator command. An operator may input the operator command in response to the refresh signal. The operator may input the operator command in response to a visual reduction in print quality achieved by the printer.

The determining 210 may be performed automatically by the printer after the passing 290 imaging oil from the reservoir to the tank, which can help to determine whether the method 200 should be repeated to further mitigate degradation of printing fluid in the tank. The determining 210 may be performed automatically by the printer at predetermined intervals. The determining 210 may be performed substantially continuously.

The draining 240 may comprise: opening 242 an outlet valve at an outlet of the tank, detecting 244 a volume of printing fluid drained from the tank during the draining 240, and closing 246 the outlet valve when a predetermined volume of printing fluid has been drained from the tank. The outlet valve may be switchable between a first state, in which printing fluid can flow through the outlet of the tank, and a second state, in which printing fluid is prevented from flowing through the outlet of the tank by the outlet valve.

The opening 242 may be performed automatically by the printer on the basis of the refresh signal. The opening 242 may be performed in response to an operator command. The operator may input the operator command in response to the refresh signal. The operator may input the operator command in response to a visual reduction in print quality achieved by the printer.

The volume of printing fluid drained from the tank during the draining 240 may be proportional to a degree of degradation of the printing fluid. The detecting 244 may comprise measuring a flow rate of fluid through the outlet and the time from the opening 242 to calculate a volume of printing fluid drained from the tank during the draining 240. The detecting 244 may comprise using a predetermined flow rate through the outlet and measuring a time from the opening 242 to calculate a volume of printing fluid drained from the tank during the draining 240. The detecting 244 may comprise measuring a mass of the tank and using a predetermined density of the printing fluid to calculate a volume of printing fluid drained from the tank during the draining 240. The detecting 244 may comprise measuring a printing fluid level in the tank and comparing the measured printing fluid level to a printing fluid level prior to the opening 242 to calculate a volume of printing fluid drained from the tank during the draining 240. Other ways of performing the detecting 244 may be employed in the method 200.

The filtering 270 of the method 200 may comprise electrostatically separating 275 the solids from the imaging oil. The filtering 270 may be performed by an electrostatic separator. The filtering 270 may comprise passing solids removed from the imaging oil to a waste container (not shown). The waste container may be periodically emptied and the contents disposed of, for example manually by an operator of the printer.

At least a portion of the method 200 may be performed automatically by the printer. For example, stopping the draining before the tank is empty may be performed in response to a determination that the volume of printing fluid in the tank has fallen below a draining threshold. For example, passing 290 imaging oil from the reservoir to the tank may be performed in response to a determination by the printer that the volume of printing fluid in the tank has fallen below a printing fluid volume threshold. All of the method 200 may be performed automatically by the printer. The method 200 may be performed at automatically at predetermined intervals. The method 200 may be performed continuously when printing fluid is stored in the tank.

The method 300 may be performed in response to an operator command. The operator command is input to the printer by an operator of the printer. The operator may input the operator command in response to determining degradation of the printing fluid stored in the tank.

The method 200 may be performed multiple times to mitigate degradation of the printing fluid stored in the tank.

The method 200 can help to reduce the downtime of the printer caused by the need to mitigate degradation of printing fluid in the tank, because the draining 240 is stopped before the tank is empty. The method 200 may be performed whilst the printer is performing a printing process using printing fluid from the tank. The method 200 may allow a printer to mitigate printing fluid degradation without components of printing fluid being supplied to the printer from an external source.

Figure 3:
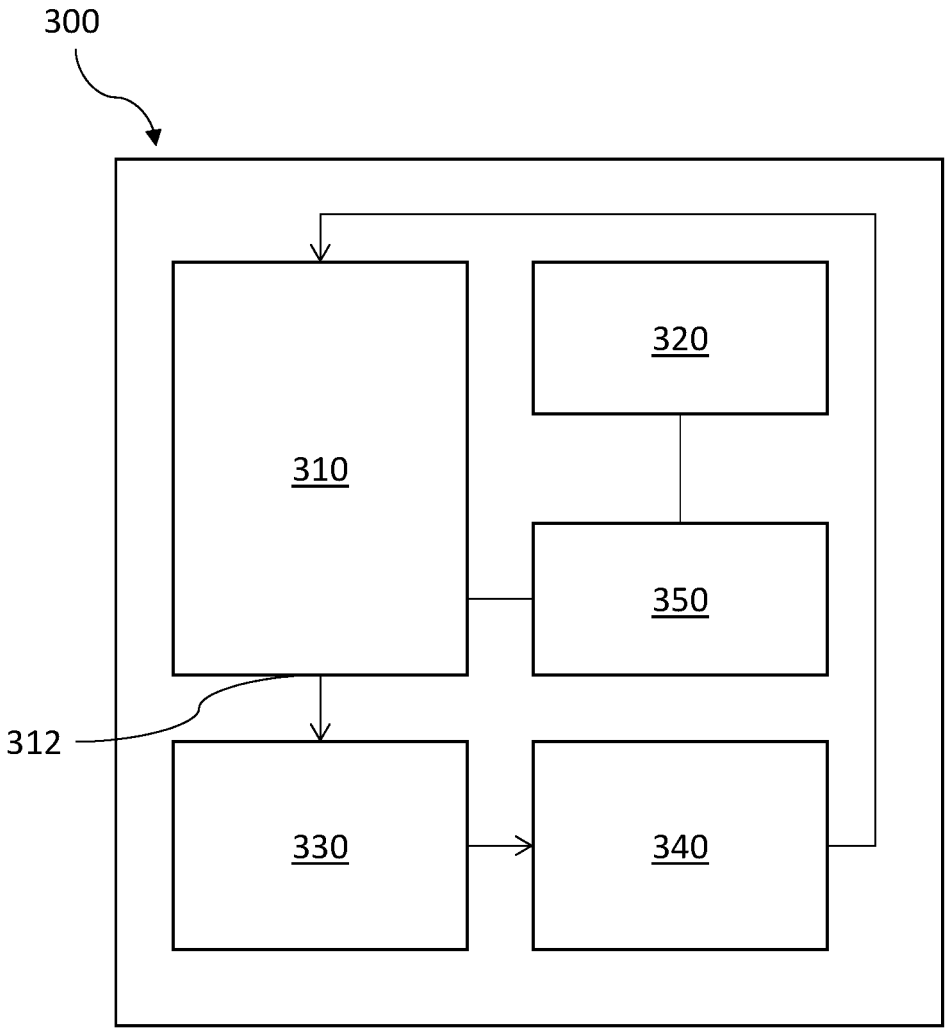
FIG. 3 is a schematic diagram of a printer according to the disclosure.

FIG. 3 is a schematic diagram of a printer 300 according to the disclosure. The printer 300 may be a liquid electrostatic printer. The printer 300 comprises a tank 310 to hold printing fluid. The printing fluid comprises solids suspended in imaging oil, and is for use by the printer 300 for printing on a print medium. The tank 310 comprises an outlet 312 to selectively drain printing fluid from the tank 310.

The printer 300 comprises one or more sensors 320 to detect a parameter of the printer 300. The one or more sensors 320 may, for example, be to detect one or more of: a print quality achieved by the printer 300, a colour calibration accuracy, a concentration of solids in the printing fluid, a printing fluid temperature, a printing fluid viscosity, and a volume of printing fluid in the tank 310.

The printer 300 comprises a filter 330 to receive printing fluid from the outlet 312, and to filter the received printing fluid to separate the solids from the imaging oil. The filter 330 may be to separate substantially all of the solids from the imaging oil. The filter 330 may be to pass solids separated from the imaging oil to a waste container (not shown). The waste container may be periodically emptied and the contents disposed of, for example manually by an operator of the printer.

The printer 300 comprises a reservoir 340 to hold imaging oil. The reservoir 340 is to receive filtered imaging oil from the filter 330 and to provide imaging oil to the tank 310.

The printer 300 comprises a controller 350 to cause draining of printing fluid from the tank 310 via the outlet 312, on the basis of a determination that the parameter detected by the one or more sensors 320 meets a predetermined criterion. The controller 350 may be to receive an output of the one or more sensors 320, the output being indicative of the detected parameter. The controller 350 may be to determine that the detected parameter meets the predetermined criterion. The controller 350 may cause the draining of printing fluid from the tank 310 via the outlet 312 to stop, when it is determined that the volume of printing fluid in the tank 310 has fallen below a threshold volume, the threshold volume being greater than zero.

The components of the printer 300 shown in FIG. 3 permit the printer 300 to mitigate degradation of printing fluid held in the tank 310. The printer 300 may be to mitigate printing fluid degradation without components of printing fluid being supplied to the printer 300 from an external source. The printer 300 may be to perform the method 100 or the method 200 described with reference to FIGS. 1 and 2, respectively. For example, the filter 330 may perform the filtering 170, 270 of printing fluid from the tank 310.

Figure 4:
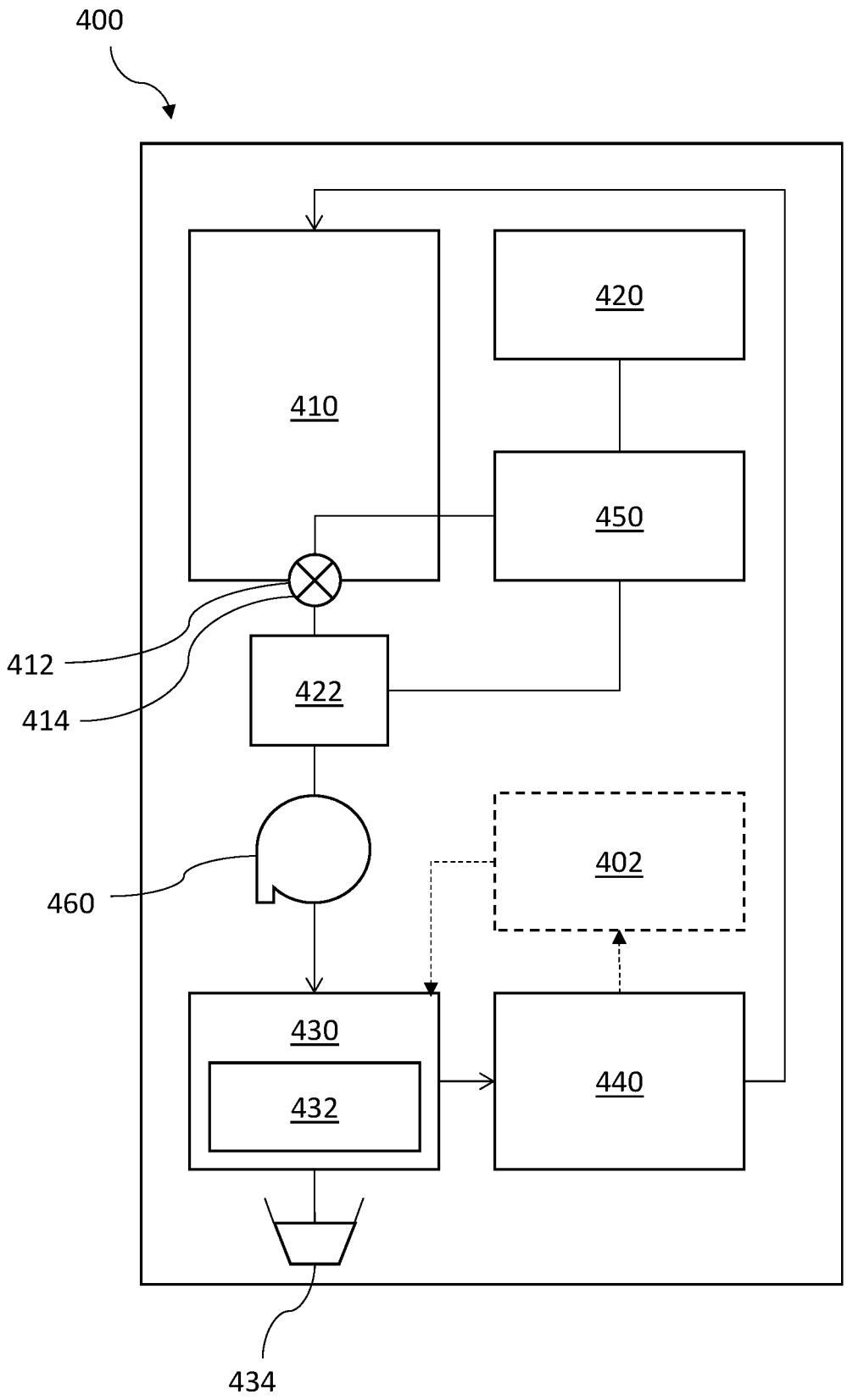
FIG. 4 is a schematic diagram of a printer according to the disclosure.

FIG. 4 is a schematic diagram of a printer 400 according to the disclosure. The printer 400 comprises the components of the printer 300 shown in FIG. 3. Corresponding components of the printer 400 have the same reference number as for the printer 300, but increased by 100. The corresponding components of the printer 400 will not be described again with reference to FIG. 4. The printer 400 may be a liquid electrostatic printer.

The printer 400 may comprise an outlet valve 414 associated with the outlet 412. The outlet valve 414 is switchable between a closed position, in which printing fluid cannot flow through the outlet 412, and an open position, in which printing fluid can flow through the outlet 412. The controller 450 may be to switch the outlet valve 414 from the closed position to the open position on the basis of a determination that the parameter detected by the one of more sensors 420 meets the predetermined criterion. The parameter may, for example, comprise one or more of: a print quality achieved by the printer 400, a colour calibration accuracy, a concentration of solids in the printing fluid, a printing fluid temperature, a printing fluid viscosity, and a volume of printing fluid in the tank 410.

The one or more sensors 420 of the printer 400 may comprise an outlet detector 422 to detect a parameter indicative of a volume of printing fluid drained from the tank 410 through the outlet 412. The parameter detected by the outlet detector 422 may, for example, comprise one or more of: a flow rate of printing fluid flowing through the outlet 412, a mass of the printing fluid in the tank 410, a time for which the outlet valve 414 has been in the open position, and a level of printing fluid in the tank 410. The outlet detector 422 may, for example, comprise one or more of: a flow meter, a light sensor, a mass sensor and a time sensor.

The controller 450 may be to switch the outlet valve 414 from the open position to the closed position on a basis of a determination that a predetermined volume of printing fluid has been drained from the tank 410. The predetermined volume may be dependent on a degree of degradation of the printing fluid in the tank 410. The predetermined volume may be dependent on the volume of printing fluid in the tank 410 immediately prior to the outlet valve 414 being switched from the closed position to the open position. The determination that a predetermined volume of printing fluid has been drained from the tank 410 is based on an output of the outlet detector 422. The controller 450 may be to switch the outlet valve 414 from the open position to the closed position when it is determined that the volume of printing fluid in the tank 410 has fallen below a threshold volume, irrespective of the output of the outlet detector 422, the threshold volume being greater than zero.

The printer 400 may comprise a pump 460 to supply printing fluid from the outlet 412 to the filter 430. The pump 460 may be to supply printing fluid to the filter 430 at a pressure that is sufficient to push the printing fluid through the filter 430 and to the reservoir 440. The pump 460 may be to supply printing fluid 430 to the filter 430 at a substantially constant pressure.

The filter 430 of the printer 400 may comprise an electrostatic separator 432 to separate the solids from the imaging oil. The electrostatic separator 432 may be to separate substantially all of the solids from the imaging oil. The printer may comprise a waster container 434. The filter 430 may be to pass solids separated from the imaging oil to a waste container 434. The waste container may be periodically emptied and the contents disposed of, for example manually by an operator of the printer.

The filter 430 may be usable with another imaging oil system 402 comprised in the printer 400. For example, the printer 400 may comprise an imaging oil cleaning system 402 to circulate imaging oil through the printer 400 to clean one or more components of the printer 400. The another imaging oil system 402 may be fluidly connected to the filter 430, and may be fluidly connected to the filter 430 via the pump 460. The reservoir 400 may be fluidly connected to the at least one imaging oil system 402 to provide filtered imaging oil to the another imaging oil system 402.

The components of the printer 400 shown in FIG. 4 permit the printer 400 to mitigate degradation of printing fluid held in the tank 410. The printer 400 may be to mitigate printing fluid degradation without components of printing fluid being supplied to the printer 400 from an external source. The printer 400 may be to perform the method 100 or the method 200 described with reference to FIGS. 1 and 2, respectively. For example, the filter 330 may perform the filtering 170, 270 of printing fluid from the tank 310. For example, the outlet detector may perform the detecting 244 a volume of printing fluid drained from the tank during the draining 240.

Figure 5:
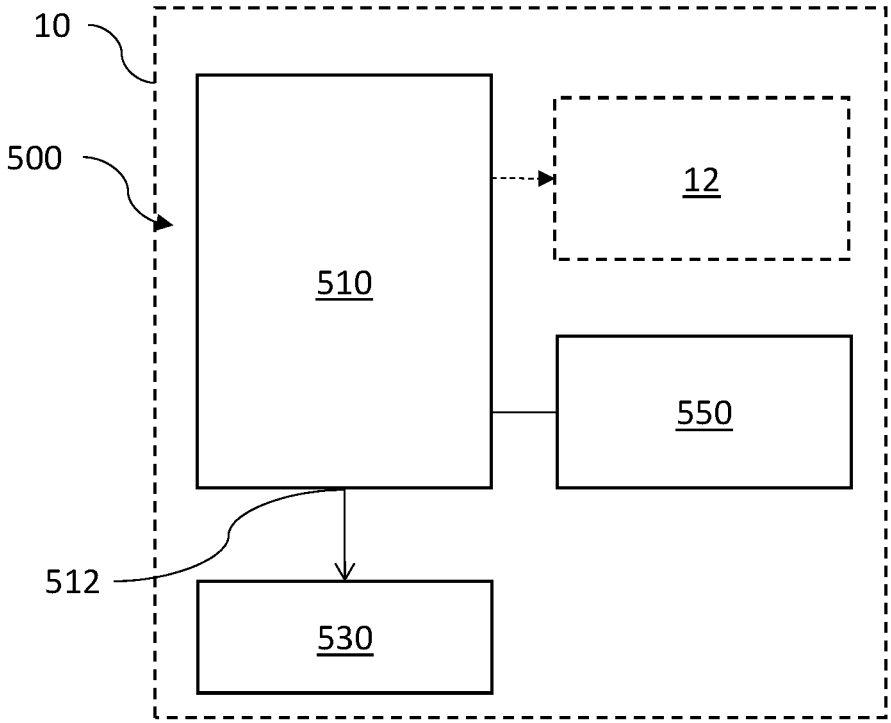
FIG. 5 is a schematic diagram of a system according to the disclosure.

FIG. 5 is a schematic diagram of a system 500 according to the disclosure. The system 500 may be comprised in a printer 10. The printer 10 may be a liquid electrostatic printer.

The system 500 comprises a tank 510 to hold printing fluid. The printing fluid may be for use in printing by the printer 10. The tank 510 comprises a print outlet 512 to deliver printing fluid from the tank 510 to a printing system 12 of the printer 10. The tank 510 comprises a separator outlet 512. The separator outlet 512 may be to permit selective draining of printing fluid from the tank 510.

The system 500 comprises a separator 530 to receive printing fluid from the separator outlet 512, and to separate at least some solids from imaging oil comprised in the printing fluid received from the tank 510 via the separator outlet 512. The separator 530 may comprise an electrostatic separator (not shown). The separator 530 may comprise a solids outlet (not shown) for removing the at least some solids separated from the imaging oil by the separator 530 from the system 500.

The system 500 may comprise a fluid pathway (not shown) between the separator 530 and an inlet (not shown) of the tank 510 for passing imaging oil from the separator 530 to the inlet of the tank 510. The fluid pathway may comprise a container (not shown) for storing imaging oil received from the separator 530 until the imaging oil is passed to the inlet of the tank 510. The pathway may comprise a pump to selectively pass imaging oil from the separator 530 to the inlet of the tank 510. The inlet of the tank 510 may comprise an inlet valve (not shown) to selectively permit imaging oil to flow from the fluid pathway into the tank 510 via the inlet.

The system 500 comprises a controller to cause printing fluid to be delivered from the tank 510 to the separator 530 via the separator outlet 512, on the basis of a determination that a quality of the printing fluid in the tank 510 has fallen below a predetermined threshold.

The system 500 may be to mitigate printing fluid degradation without components of printing fluid being supplied to a printer from an external source. The system 500 may be to perform the method 100 or the method 200 described with reference to FIGS. 1 and 2, respectively. For example, the separator 510 may perform the filtering 170, 270 of the printing fluid drained from the tank 510. For example, the controller 550 be to determine 210 whether a parameter of the system 500 meets a predetermined criterion.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method, comprising:

draining printing fluid from a tank of a printer, the printing fluid comprising solids suspended in imaging oil;

stopping the draining when a volume of printing fluid in the tank has fallen below a draining threshold, the draining threshold being greater than zero;

filtering the printing fluid drained from the tank to separate at least some of the solids from the imaging oil;

passing the filtered imaging oil to a reservoir; and then passing imaging oil from the reservoir to the tank.

2. A method according to claim 1, comprising:

determining whether a parameter of the printer meets a predetermined criterion, wherein the draining is performed based on the parameter meeting the predetermined criterion.

3. A method according to claim 2, wherein the parameter is indicative of a degree of degradation of the printing fluid, and an amount of printing fluid drained from the tank during the draining is proportional to the degree of degradation of the printing fluid.

4. A method according to claim 2, wherein the parameter comprises one or more of a print quality achieved by the printer, a colour calibration accuracy, a concentration of solids in the printing fluid, a printing fluid temperature, a printing fluid viscosity, and a volume of printing fluid in the tank.

5. A method according to claim 1, wherein the filtering comprises electrostatically separating the solids from the imaging oil.

6. A method according to claim 1, wherein passing imaging oil from the reservoir to the tank comprises passing imaging oil from the reservoir to the tank in response to determining that a volume of printing fluid in the tank is below a printing fluid volume threshold.

7. A method according to claim 1, wherein passing imaging oil from the reservoir to the tank includes mixing the imaging oil with the printing fluid remaining in the tank after the draining; and further comprising:

adding solids to the tank to restore a predetermined concentration of solids suspended in imaging oil within the printing fluid stored in the tank.

8. A printer, comprising:

a tank to hold printing fluid, the printing fluid comprising solids suspended in imaging oil, wherein the tank comprises an outlet to selectively drain printing fluid from the tank;

a filter to receive printing fluid from the outlet, and to filter the received printing fluid to separate the solids from the imaging oil;

a reservoir to hold imaging oil, the reservoir to receive filtered imaging oil from the filter and to provide imaging oil to the tank; and a controller to cause draining of printing fluid from the tank via the outlet, and to cause stopping of the draining on the basis of a determination that a volume of printing fluid in the tank has fallen below a draining threshold, the draining threshold being greater than zero.

9. A printer according to claim 8, wherein an amount of printing fluid drained from the tank during the draining is proportional to a degree of degradation of the printing fluid.

10. A printer according to claim 8, comprising one or more sensors to detect a parameter of the printer, wherein the parameter comprises one or more of: a print quality achieved by the printer, a colour calibration accuracy, a concentration of solids in the printing fluid, a printing fluid temperature, a printing fluid viscosity, and a volume of printing fluid in the tank.

11. A printer according to claim 8, wherein the controller is to cause passing of imaging oil from the reservoir to the tank.

12. A printer according to claim 11, wherein the controller is to cause passing of imaging oil from the reservoir to the tank in response to a determination that a volume of printing fluid in the tank is below a printing fluid volume threshold.

13. A printer according to claim 11, wherein imaging oil from the reservoir is to mix with the printing fluid remaining in the tank after the draining; and wherein solids are to be added to the tank to restore a predetermined concentration of solids suspended in imaging oil within the printing fluid stored in the tank.

14. A system, comprising:

a tank to hold printing fluid;

a separator to receive printing fluid from the tank and to separate at least some solids from imaging oil comprised in the printing fluid received from the tank; and a controller to cause printing fluid to be drained from the tank and delivered from the tank to the separator, and to stop printing fluid from being drained from the tank on the basis of a determination that a volume of printing fluid in the tank has fallen below a draining threshold, the draining threshold being greater than zero.

15. A system according to claim 14, wherein the controller is to cause printing fluid to be drained from the tank and delivered from the tank to the separator on the basis of a determination that a quality of the printing fluid in the tank has fallen below a predetermined threshold.

16. A system according to claim 14, wherein the controller is to cause printing fluid to be drained from the tank and delivered from the tank to the separator on the basis of a determination that a parameter of the printer meets a predetermined criterion.

17. A system according to claim 16, wherein the parameter is indicative of a degree of degradation of the printing fluid, and an amount of printing fluid drained from the tank is proportional to the degree of degradation of the printing fluid.

18. A system according to claim 16, wherein the parameter comprises one or more of a print quality achieved by the printer, a colour calibration accuracy, a concentration of solids in the printing fluid, a printing fluid temperature, a printing fluid viscosity, and a volume of printing fluid in the tank.

19. A system according to claim 14, further comprising:

a reservoir to receive separated imaging oil from the separator, wherein the controller is to cause imaging oil to be passed from the reservoir to the tank in response to a determination that a volume of printing fluid in the tank is below a printing fluid volume threshold.

20. A system according to claim 19, wherein imaging oil from the reservoir is to mix with the printing fluid remaining in the tank after the draining; and wherein solids are to be added to the tank to restore a predetermined concentration of solids suspended in imaging oil within the printing fluid stored in the tank.

* * * * *